United States Patent [19]

Kajita et al.

[11] 4,353,557

[45] Oct. 12, 1982

[54] GOLF BALL

[75] Inventors: Ryota Kajita, Matsudo; Tasuku Saito, Tokorozawa; Tsutomu Matsunaga, Iruma; Sakae Inoue, Kodaira; Masayuki Ohtake, Yokohama, all of Japan

[73] Assignee: Bridgestone Tire Company, Limited, Tokyo, Japan

[21] Appl. No.: 126,748

[22] Filed: Mar. 3, 1980

[30] Foreign Application Priority Data

Mar. 16, 1979 [JP] Japan ..... 54-31326

[51] Int. Cl.[3] ..... A63B 37/12; C08K 3/04; C08L 7/00; C08L 9/00

[52] U.S. Cl. ..... 273/227; 260/763; 260/998.14

[58] Field of Search ..... 273/227, 222, 58 J; 260/42.47, 763, 998.14, 42.32

[56] References Cited

U.S. PATENT DOCUMENTS 3,119,622 1/1964 Weigert ..... 273/227

*Primary Examiner*—Allan Lieberman

*Attorney, Agent, or Firm*—Sughrue, Mion, Zinn, Macpeak and Seas

[57] ABSTRACT

A golf ball having a large carry having a core, a rubber thread layer and a cover layer, in which the rubber thread is composed of a rubber composition consisting essentially of 100 parts by weight of natural rubber and/or cis-1,4-polyisoprene and 2–20 parts by weight of carbon black.

1 Claim, 2 Drawing Figures

GOLF BALL

The present invention relates to a golf ball. Heretofore, a large number of proposals for improving the flight property of golf balls have been made. Rubber thread wound balls wherein a rubber thread is wound around a liquid or solid core and then the formed rubber thread ball is surrounded with a cover layer of balata or a metal salt of an ethylene-unsaturated carboxylic acid copolymer, have been broadly used. These rubber thread wound balls are preferred to solid balls because they are improved in various properties, some of which such as click, can not be quantitatively expressed.

The inventors have made a variety of studies, for further improving the flight property of the rubber thread wound ball and have found that the lower a loss compliance of the rubber thread, the higher the coefficient of restitution of the ball; and that it is possible to reduce the loss compliance by incorporating a given amount of carbon black in the rubber thread. It is on that basis that the present invention has been accomplished.

Accordingly, the present invention comprises a rubber thread wound golf ball composed of a core, a rubber thread layer and a cover layer, characterized in that the rubber thread of the above described rubber thread layer is prepared from a rubber composition consisting essentially of 100 parts by weight of a natural rubber and/or cis-1,4-polyisoprene and 2–20 parts by weight of carbon black.

The present invention will now be explained in more detail.

Figure 1:
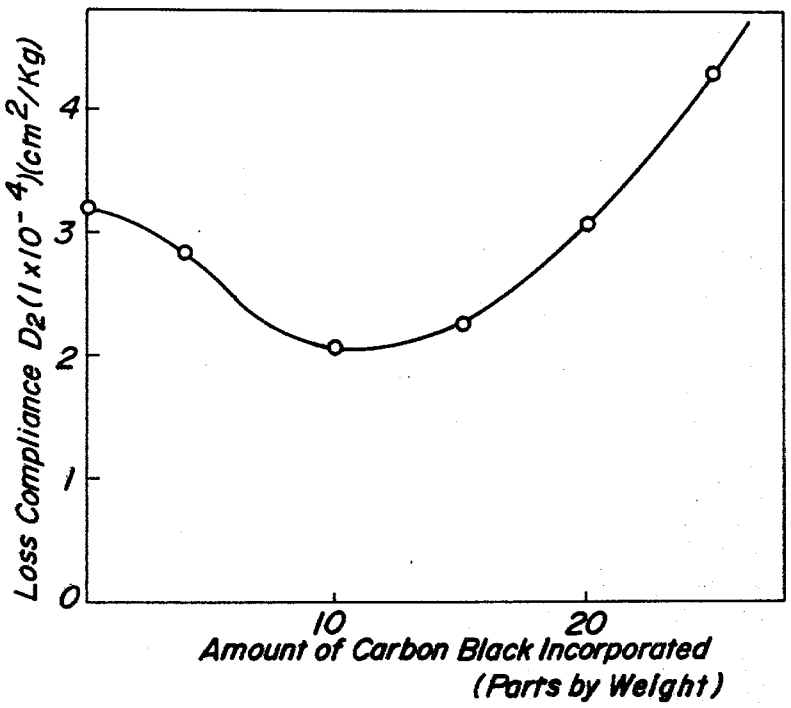
Figure 2:
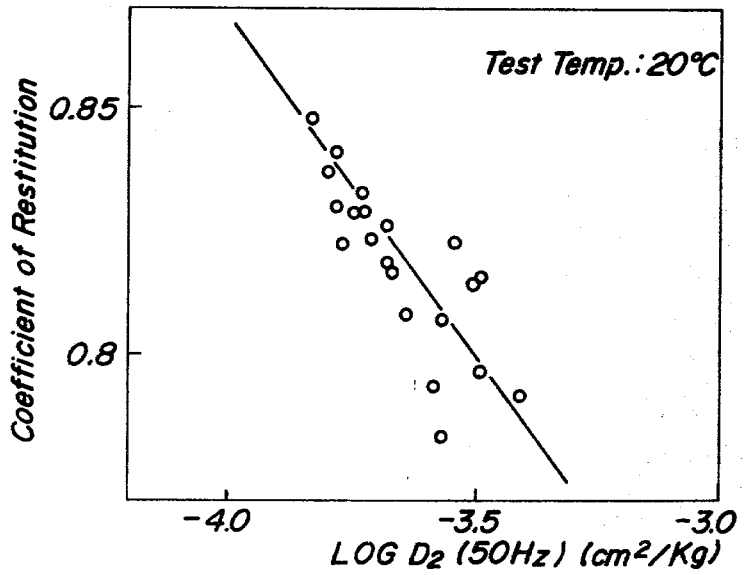

For a better understanding of the invention, reference is taken to the accompanying drawings, wherein:

FIG. 1 is a graph showing the relation of the amount of carbon black incorporated in the rubber thread to loss compliance and, FIG. 2 is a graph showing the relation of the loss compliance of the rubber thread to the coefficient of restitution of the golf ball.

The rubber component to be used for the rubber thread of the golf ball according to the present invention is natural rubber and/or cis-1,4-polyisoprene. Cis-1,4-polyisoprene is preferred to be at least 30% of cis-1,4-bond, more preferably at least 80% of cis-1,4-bond. Natural rubber and cis-1,4-polyisoprene may be used in a blend of two or more rubbers.

The rubber thread composition is composed of 2–20 parts by weight, preferably 6–16 parts by weight of carbon black in 100 parts by weight of the above described rubber component.

The higher the coefficient of restitution of the golf ball, the longer the flight distance and the lower the loss compliance of the rubber thread in the rubber thread layer, the higher the coefficient of restitution. Accordingly, it is necessary to obtain a rubber thread having a loss compliance. When the amount of carbon black incorporated in the above described rubber component is within the above described range, the loss compliance becomes lower than in the case where no carbon black is incorporated. However, when the amount of carbon black incorporated exceeds 20 parts by weight, the loss compliance becomes higher than in the case where no carbon black is incorporated, also, when said amount is less than 2 parts by weight, the effect of the addition of carbon black is not obtained.

Any carbon black to be used for incorporation in rubbers may be used as carbon black to be used in the present invention. The typical carbon blacks are for example oil furnace blacks, such as fast extrusion furnace (FEF), high abrasion furnace (HAF), HAF-LS (low structure), HAF-HS (high structure), super abrasion furnace (SAF), intermediate super abrasion furnace (ISAF), general purpose furnace (GPF), conductive furnace (CF) and the like; gas furnace blacks, such as fine furnace (FF), high modulus furnace (HMF), semi-reinforcing furnace (SRF) and the like; channel blacks, such as easy processing channel (EPC) or medium processing channel (MPC) and the like. Among those listed, oil furnace blacks, particularly FEF, HAF and HAF-LS are preferable.

Additives generally used for the rubber thread, such as antioxidants, vulcanization accelerators, accelerator activators and the like other than carbon black may be used in the composition for the rubber thread.

These additives can be mixed in the usual process and the mixture is shaped into a sheet form and the sheet is cut into a rubber thread after vulcanization.

The thus formed rubber thread is wound around the ball core in the same manner as the rubber thread wherein no carbon black is incorporated, but depending upon the hardness, required for the golf ball, a tension of 20–90 kg/cm$^2$ is applied to the rubber thread. The rubber thread is therefore wound around the core in the stretched state.

The incorporation of carbon black causes relaxation after stretching, so that it is desirable to apply a higher tension than in the case where no carbon black is incorporated.

On the other hand, the modulus of the rubber thread is improved by the incorporation of carbon black, so that when it is intended to obtain the required hardness, the elongation ratio may be smaller than in such case as the rubber thread does not contain carbon black and the thread winding time is shortened by at least 10% so that the operability is improved.

The following examples are given for the purpose of illustration of this invention and are not intended as limitations thereof.

EXAMPLE

The components shown in the following Table 1 were mixed following the conventional process by means of a Banbury mixer and the mixture was rolled and heated at 141° C. for 40 minutes to prepare a vulcanized rubber sheet having a thickness of 0.4 mm. This sheet was cut in a breadth of 2 mm to form rubber threads. The formed rubber thread was wound around a core mainly composed of polybutadiene so that the compression of the ball became 90 and the wound core was surrounded with a cover layer consisting essentially of balata to form a ball.

The coefficient of restitution of the formed ball was determined as follows. The ball was impacted on to a resilient steel plate at a speed of 38 m/sec and the relative speed ratio of the ball before and after the impact at a distance of 10 cm from the plate was determined.

The same ball was hit with a driver of wood No. 1 by means of a golf ball hitting tester (made by True Temper Co.) at a head speed of 47 m/sec and the carry was measured.

The obtained results are shown in Table 1.

TABLE 1

| | | Sample No. 1 | Sample No. 2 |
|---|---|---|---|
| Composition (parts by weight) | | | |
| Natural rubber | | 70 | 70 |
| Polyisoprene (1) | | 30 | 30 |
| FEF black | | 10 | — |
| Stearic acid | | 2 | 2 |
| Zinc oxide | | 2 | 2 |
| N—cyclohexylbenzothiazol sulfenamide | | 0.5 | 0.5 |
| Sulfur | | 2 | 2 |
| Performance of the ball | | | |
| Carry (m) | Ball temperature 0° C. | 185.2 | 180.4 |
| | Ball temperature 20° C. | 204.4 | 200.6 |
| Coefficient of restitution | Ball temperature 0° C. | 0.727 | 0.716 |
| | Ball temperature 20° C. | 0.798 | 0.785 |
| Compression | | 90 | 90 |

Note (1):
Cariflex IR 305 (made by Shell Chemical Co. Ltd. Trade Mark)

REFERENCE EXAMPLE 1

Rubber threads having a varied amount of carbon black incorporated as shown in FIG. 1 were prepared in the same composition as shown in the above Example other than the carbon black amount and the loss compliance of the obtained threads was measured.

The loss compliance $D_2$ was determined as follows. The rubber thread was fixed in a spectrometer at −15° C. by applying to the thread an original strain necessary for obtaining a compression of 90 on the ball, and a vibration of a frequency of 50 Hz was applied to the thread. Dynamic modulus E and loss tangent tan δ were measured and $D_2$ was determined from the following formula:

$$D_2 = \frac{\tan \delta}{E(1 + \tan^2 \delta)}$$

The results obtained are shown in FIG. 1.

It can be seen from FIG. 1 that when 2–20 parts by weight of carbon black is incorporated in the rubber thread composition, the loss compliance $D_2$ is lowered.

REFERENCE EXAMPLE 2

The loss compliance $D_2$ of the heretofore used rubber threads having various compositions was measured and the coefficient of restitution of balls obtained by using these rubber threads was measured. The obtained relation of the coefficient of restitution to the loss compliance $D_2$ is shown in FIG. 2.

The result of FIG. 2 shows that as the loss compliance $D_2$ decreases, the coefficient of restitution becomes larger.

As mentioned above, according to the present invention it is possible to reduce the loss compliance of the rubber thread by incorporating the given amount of carbon black in natural rubber and/or cis-1,4-polyisoprene. The golf ball according to the present invention wherein this rubber thread is used, is higher in the coefficient of restitution, that is the flight property is remarkably improved, so that the present invention is very useful.

What is claimed is:

1. In a rubber thread wound golf ball composed of a core, a rubber thread layer and a cover layer, the improvement comprising; wherein the rubber thread in the rubber thread layer of a rubber composition consists essentially of 100 parts by weight of at least one rubber component selected from the group consisting of natural rubber cis-1,4-polyisoprene and mixtures thereof, and 2–20 parts by weight of carbon black.

* * * * *